US006529609B1

(12) United States Patent
Neilson et al.

(10) Patent No.: US 6,529,609 B1
(45) Date of Patent: Mar. 4, 2003

(54) PULLER AND METHODS OF MAKING AND USING THE SAME

(75) Inventors: Mark A. Neilson, Zimmerman, MN (US); Roger Neilson, Jr., Brooklyn Park, MN (US)

(73) Assignee: In'Tech Industries, Inc., Maple Grove, MN (US)

( * ) Notice: Subject to any disclaimer, the term of this patent is extended or adjusted under 35 U.S.C. 154(b) by 0 days.

(21) Appl. No.: 09/182,157

(22) Filed: Oct. 29, 1998

(51) Int. Cl.[7] ..... H04R 25/00

(52) U.S. Cl. ..... 381/329; 381/322; 381/328; 381/380; 379/52

(58) Field of Search ..... 381/314, 320, 381/322, 324, 326, 328, 329, 313, 133, 130, 312, 315, 380; 379/52

(56) References Cited

U.S. PATENT DOCUMENTS 5,003,608 A * 3/1991 Carlson
5,381,484 A * 1/1995 Claes
5,395,168 A * 3/1995 Leenen
6,055,319 A * 4/2000 Shennib

* cited by examiner

*Primary Examiner*—Huyen Le
*Assistant Examiner*—Dionne N. Harvey
(74) *Attorney, Agent, or Firm*—Alan D. Kamrath; Rider, Bennett, Egan & Arundel

(57) ABSTRACT

A hearing aid puller comprises a first member, and a first end piece coupled to the first member. An intermediate piece is coupled to the first member. A second member is coupled to the intermediate piece. A second end piece is coupled to the second member. The cross-sectional width of the intermediate piece and the maximum width of the second end piece are larger than the cross-sectional width of the second member. The hearing aid puller may be formed by injecting liquefied, elastically deformable material into a mold. The liquefied, elastically deformable material is cooled to form a hearing aid puller that is a single part that can be stretched to more than about twice the puller's original molded length.

37 Claims, 7 Drawing Sheets

PULLER AND METHODS OF MAKING AND USING THE SAME

FIELD OF THE INVENTION

The present invention generally relates to mechanical and chemical technology, and more specifically to hearing aids.

BACKGROUND OF THE INVENTION

Persons with hearing deficiencies wear hearing aids to improve their hearing ability. For cosmetic reasons, these persons typically desire to wear hearing aids that are not readily visible to others. One type of hearing aid that is not readily visible to others is a Completely In the Canal (CIC) hearing aid.

A CIC hearing aid 101 is recessed within the canal 103 of a person's ear 105, as illustrated in FIG. 1. Therefore, the CIC hearing aid 101 is not readily visible to others. Because it is recessed in the ear canal, the CIC hearing aid 101, however, is difficult to remove. Removal is particularly troublesome for persons having diminished finger dexterity. Therefore a puller is attached to the CIC hearing aid 101.

A conventional puller, for a CIC hearing aid 101, is formed from a piece of monofilament fish line, e.g. polyester. The fish line is knotted at its first end. This knot is manually dipped into acrylic to form a ball. The ball permits the CIC hearing aid 101 wearer to more readily grasp the puller. After the ball is formed, the second end of the puller is inserted into the CIC hearing aid 101. The second end is knotted. To attach the puller to the CIC hearing aid 101, the knotted second end is manually glued to the CIC hearing aid 101.

The conventional puller has deficiencies. First, the conventional puller may be labor intensive to manufacture and install, and thus may be relatively expensive. For example, in addition to the steps described above, each puller is individually cut, from a spool of the monofilament fishline, in different lengths to satisfy individual user requirements. Also, the knots at the first and second ends are hand made.

Further, the ball is not formed uniformly on the pullers. Defects in ball formation may lead to user dissatisfaction.

Therefore, there is a need for a puller that can be manufactured and installed at lower cost. Further, there is a need for a puller that can be manufactured consistently.

SUMMARY OF THE INVENTION

The present invention solves the above-mentioned problems in the art and other problems which will be understood by those n the art upon reading and understanding the present specification. The present invention provides a puller, and methods of forming and attaching the same. The puller may be attached to a hearing aid to assist a hearing aid wearer having diminished dexterity to remove the hearing aid.

One embodiment of the hearing aid puller comprises a first member, and an end piece coupled to the first member. The hearing aid puller is a single, molded part formed from an elastically deformable material.

In another embodiment, the hearing aid puller includes a second end piece. An intermediate piece is coupled and spaced apart from the end piece by the member. A second member couples and spaces apart the intermediate and second pieces. The cross-sectional width of the intermediate piece and the maximum width of the second end piece are larger than the cross-sectional width of the second member.

In yet another embodiment, the elastically deformable material is a polyamide, such as Nylon-12.

In yet another embodiment, a hearing aid comprises a microphone, and an amplifier coupled to the microphone. A speaker is coupled to the amplifier. A housing encloses the microphone, amplifier and speaker. A puller includes an end piece. A member is coupled to the end piece. The puller is a single, molded part formed from an elastically deformable material.

In a further embodiment, the puller further comprises a second end piece. An intermediate piece is coupled and spaced apart from the end piece by the member. A second member couples and spaces apart the intermediate and second end pieces. The cross-sectional width of the intermediate piece and the maximum width of the end piece are larger than the cross-sectional width of the second member. A holder, on the housing, grasps the second member.

In another embodiment, the intermediate piece and second end piece tightly fit over the holder. In yet a further embodiment, the holder is a jaw.

In yet another embodiment, a method of attaching a puller to a hearing aid, comprises inserting a first member of the puller into a jaw of the hearing aid. The puller is pulled so that a piece of the puller squeezes through the jaw. The jaw snaps around a second member. In another embodiment, the puller is secured to the hearing aid by tightly fitting the piece and another piece over the jaw.

In another embodiment, a method of attaching a puller to a hearing aid comprises inserting a distal end of a member of the puller through a shell of the hearing aid. The distal end is attached to the shell.

In yet a further embodiment, a method of forming a hearing aid puller comprises injecting liquefied, elastically deformable material. The liquefied, elastically deformable material is cooled in a mold to form the hearing aid puller that is a single part that can be stretched to more than about twice the original molded length of the hearing aid puller. In another embodiment, the elastically deformable material is polyamide.

It is an advantage of the present invention that the hearing aid puller can be relatively inexpensively manufactured and installed. It is a further advantage that the puller can be custom stretched to a length desired by a user. It is yet a further advantage that the puller can be consistently manufactured.

DETAILED DESCRIPTION OF THE EMBODIMENTS

In the following detailed description of the preferred embodiments, reference is made to the accompanying drawings which form a part hereof and in which are shown by way of illustration specific embodiments in which the invention may be practiced. These embodiments are described in sufficient detail to enable persons skilled in the art to practice the invention, and it is to be understood that other embodiments may be utilized and that logical, mechanical and electrical changes may be made without departing from the scope of the present invention. The following detailed description is, therefore, not to be taken in a limiting sense.

Figure 1:
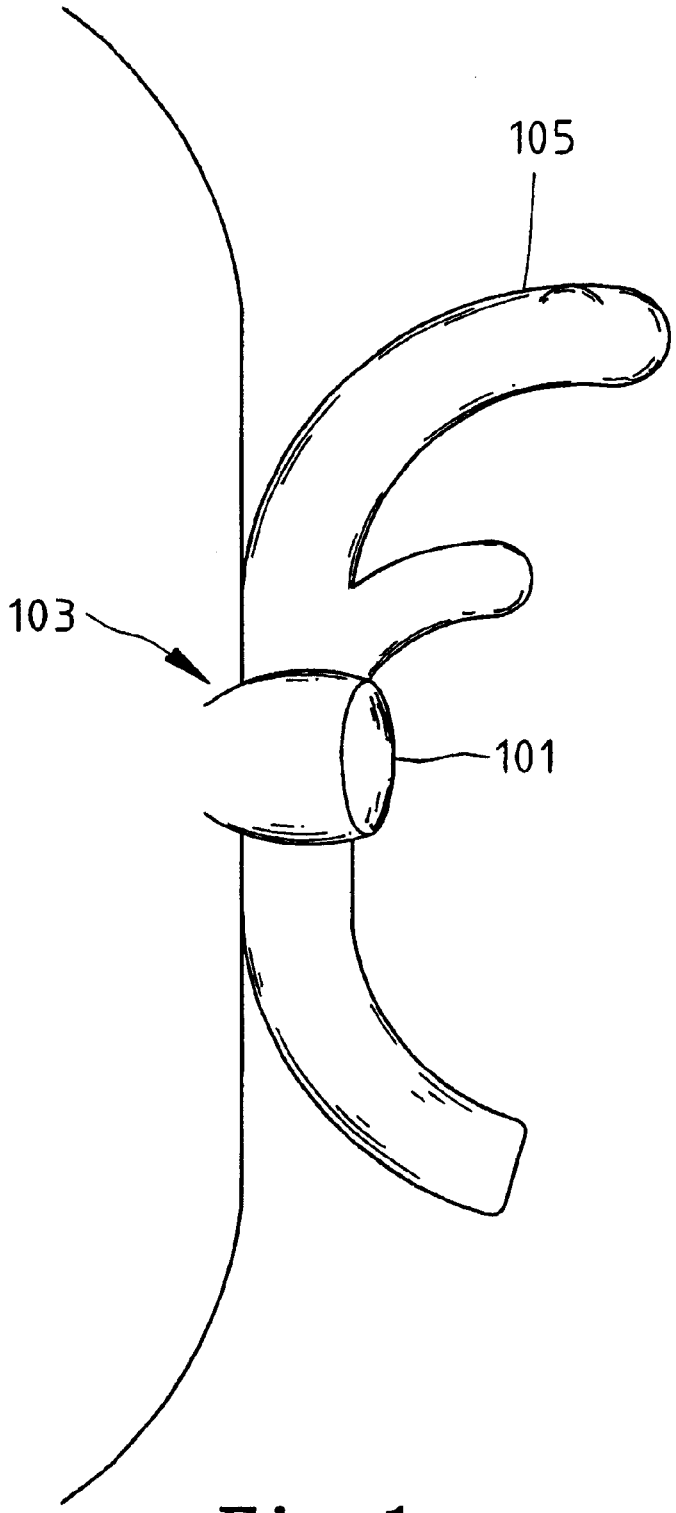
Fig. 1 PRIOR ART
FIG. 1 illustrates a prior art cross-sectional view of a Completely In the Canal hearing aid inserted into an ear.
Figure 2A:
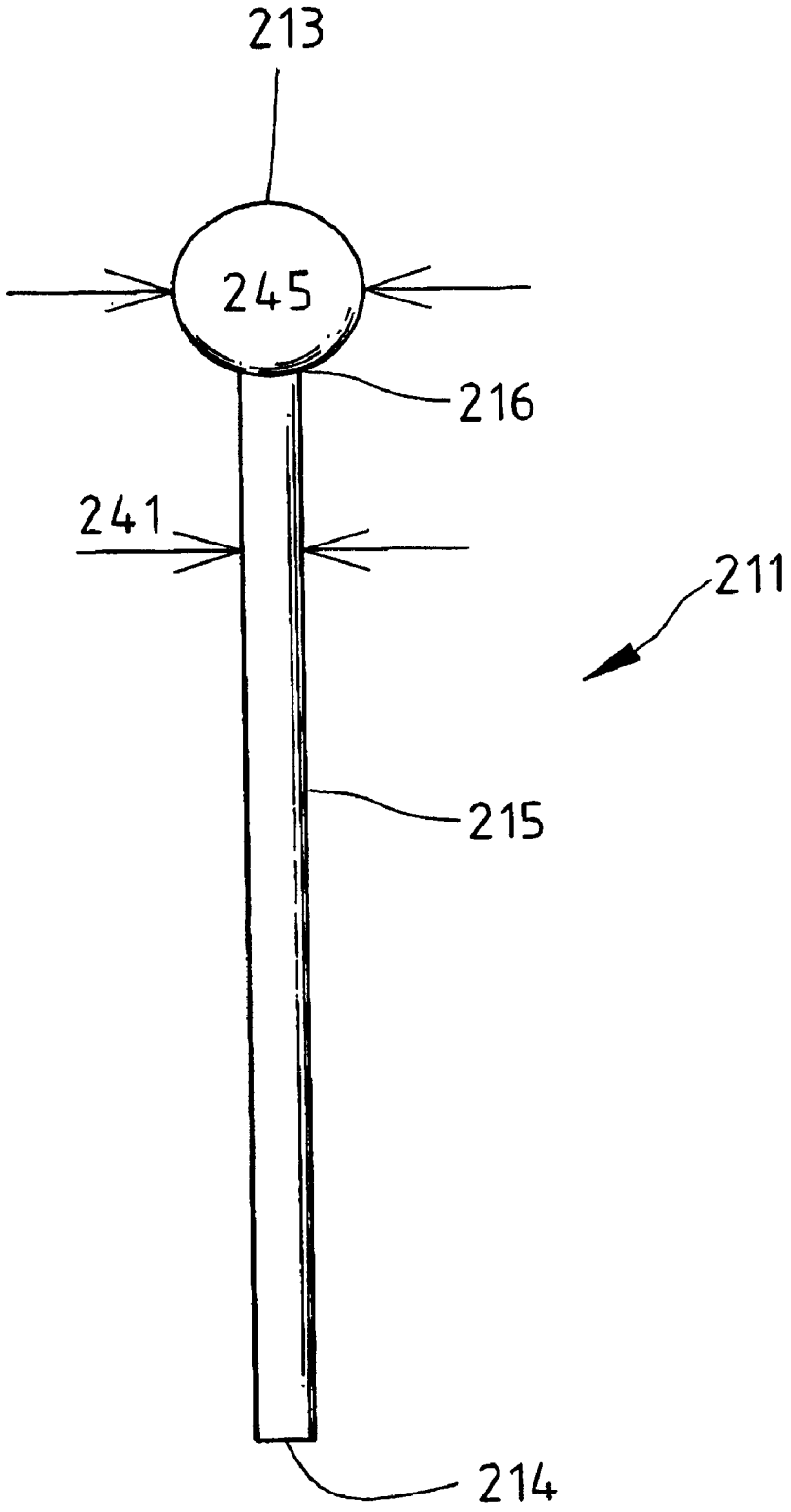
FIG. 2A illustrates a frontal view of one embodiment of a puller.

The present invention provides a method and apparatus for removing a Completely In the Canal (CIC) hearing aid from a user's ear. However, the puller is a device that may be coupled to any other device to permit a person or machine to remove this other device from a human, animal, or machine. In one embodiment, the puller 211 comprises a first end piece 213 coupled to a first member 215, as illustrated in FIG. 2A. The first member 215 has a proximal end 216, coupled to the first end piece 213, and a distal end 214.

Figure 2B:
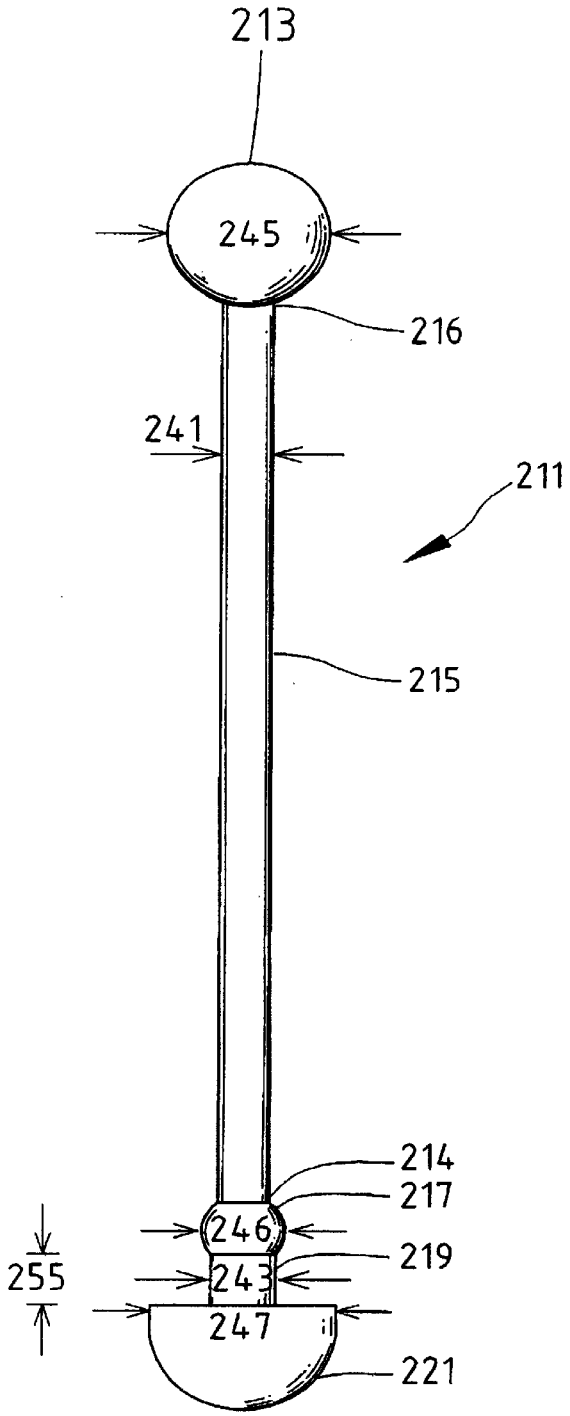
FIG. 2B illustrates a frontal view of another embodiment of the puller.
Figure 2C:
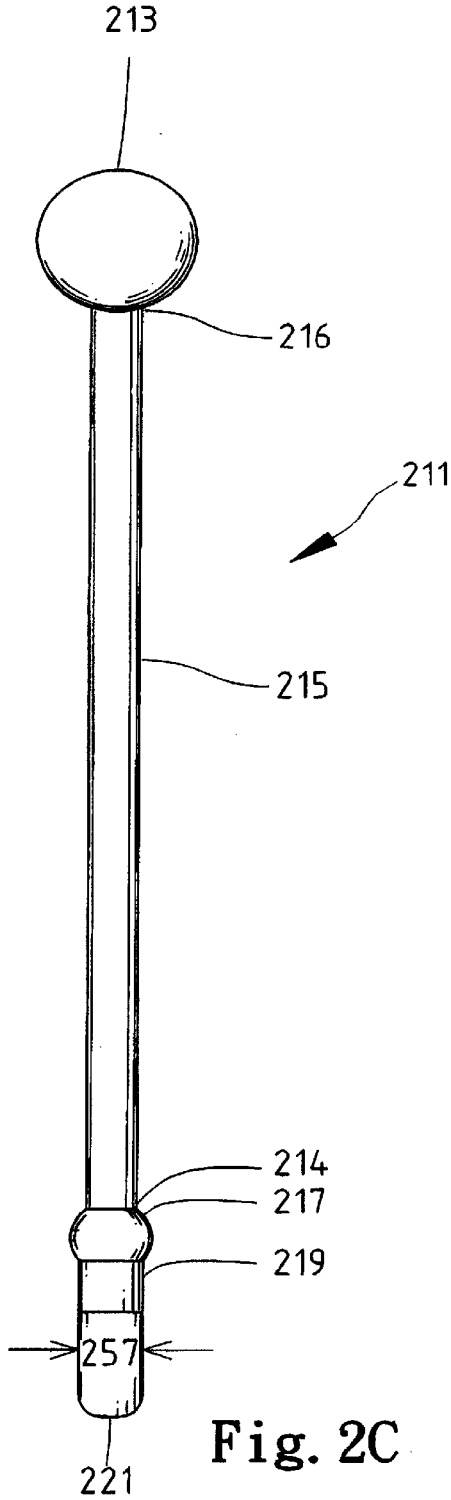
FIG. 2C illustrates a side view of the another embodiment of the puller

In another embodiment, illustrated in FIGS. 2B and 2C, the first member 215 is also coupled, at the distal end 214, to an intermediate piece 217. The intermediate piece 217 is coupled to a second end piece 221 by a second member 219.

Thus, the first member 215 separates and supports the first end piece 213 and intermediate piece 217. The second member 219 separates and supports the intermediate piece 217 and the second end piece 221.

In one embodiment, the first end piece 213 is a ball, or sphere, having a substantially round surface, as illustrated in FIGS. 2A–2C. However, in other embodiments, the first end piece 213 can have a different shape that can be gripped by a hearing aid user.

In another embodiment, the second end piece 221 has a substantially semicircular cross-section, as illustrated in FIG. 2B. However, in other embodiments, the second end piece 221 may be formed in another shape so long as it facilitates a securing function described below.

In yet another embodiment, the intermediate piece 217 is a ball having a substantially round surface. However, in other embodiments, the intermediate piece 217 may have any surface shape that permits the intermediate piece to be inserted through the holder, described below.

In yet a further embodiment, the first and second members 215, 219 have substantially circular cross-sections. However, in other embodiments, the first and second members 215, 219 may have other cross-sectional shapes so long as the first and second members 215, 219 perform their supporting and separating functions.

In another embodiment, the cross-sectional widths 241, 243 (e.g. diameters) of the first and second members 215, 219 are substantially similar, for example 0.022 inches. In another embodiment, the cross-sectional width 245 of the first end piece 213 is larger than the cross-sectional widths 241, 243 of the first and second members 215, 219. In yet another embodiment, the intermediate piece 217 has a cross-sectional width 246 (e.g. diameter), slightly larger than the cross-sectional width 241, 243 of the first and second members 215, 219. In yet a further embodiment, the second end piece 221 has a maximum cross-sectional width 247, illustrated in FIG. 2B, that is substantially larger than the cross-sectional width 241, 243 of the first and second members 215, 219.

In an alternative embodiment, illustrated in FIG. 2C, the cross-sectional width 243 of the second member 219 is larger than the cross-sectional width 241 of the first member 215, and is equivalent to the thickness 257 of the second end piece 221. In one embodiment, the puller 211 has a length of about 0.6 inches.

Figure 3A:
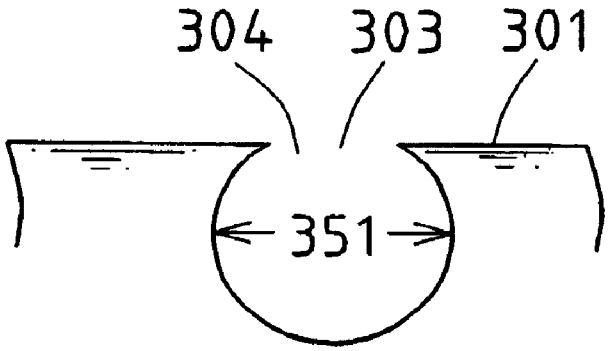
FIG. 3A illustrates a top view of one embodiment of a jaw.
Figure 3B:
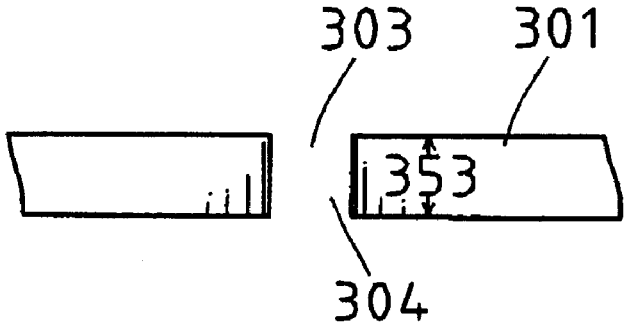
FIG. 3B illustrates a side view of one embodiment of the jaw.

In another embodiment, the puller 211 is inserted into a holder, such as a jaw 303, on the hearing aid 301, illustrated in FIGS. 3A and 3B. In one embodiment, the jaw's opening 304 has a cross-sectional width 351 (e.g. diameter) that is substantially equal to the cross-sectional width 241, 243 of the first and second members 215, 219. However, in this embodiment, the cross-sectional width 351 of the jaw's opening 304 is smaller than the cross-sectional width 246 of the intermediate piece 217 and than the maximum width 247 of the second end piece 221. Also, the height 353 of the jaw 303 is about equal to or less than the length 255 of the second member 219.

Figure 4:
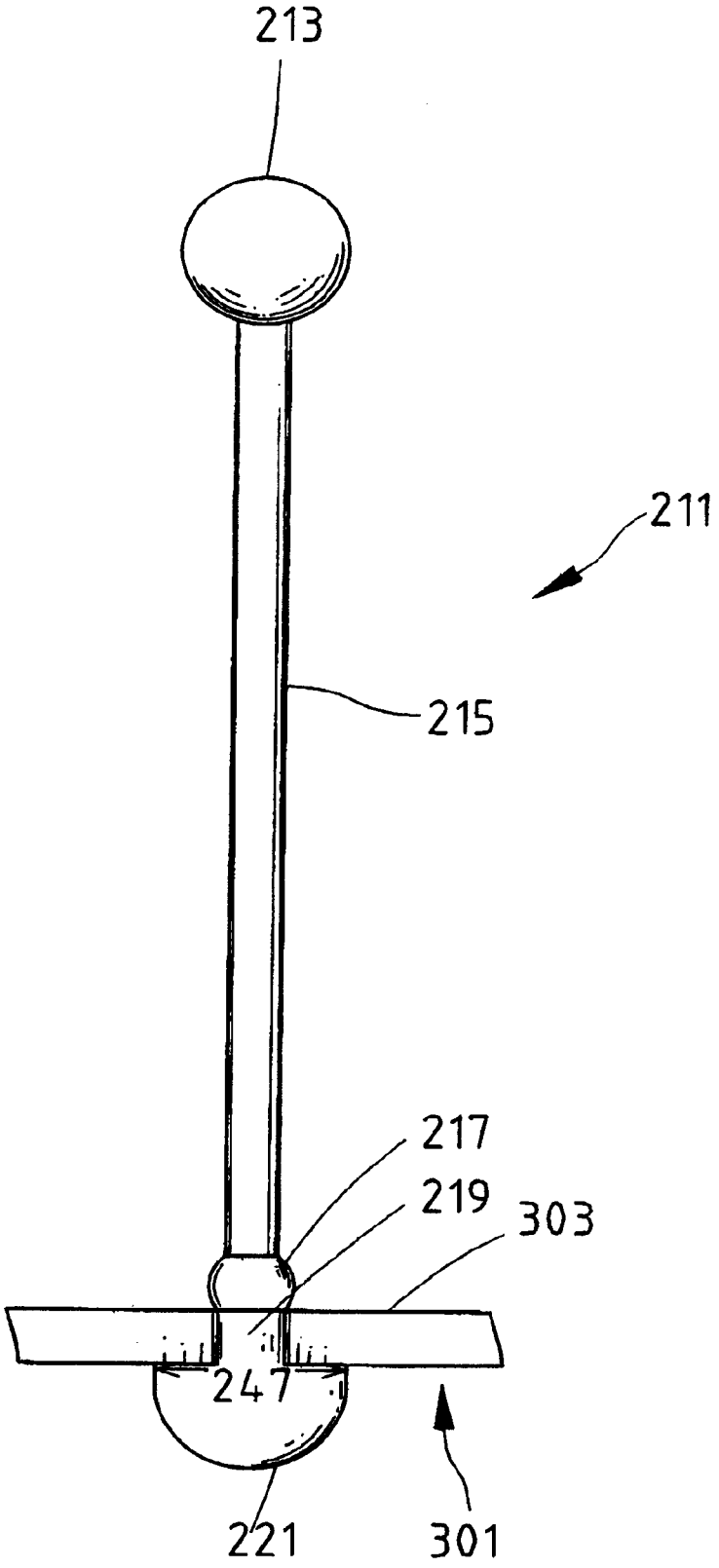
FIG. 4 illustrates one embodiment of the puller inserted into the jaw.

In one embodiment, the puller 211, illustrated in FIGS. 2B and 2C, is easily attached to the hearing aid 301 in the following manner. The first member 215 is inserted within the opening 304 of the jaw 303. In one embodiment, the puller 211 is held by the first end piece 213, with a tweezer or directly by the fingers of a person. Then, the puller 211 is pulled upwards so that the intermediate piece 217 squeezes through the jaw 303. Subsequently, the jaw 303 snaps around the second member 219, as illustrated in FIG. 4. The puller 211 is thus secured to the hearing aid 301 by the jaw's tight grasp around the second member 219. The puller 211 is further secured to the hearing aid 301 in the puller's longitudinal axis by the intermediate piece 217 and the second end piece 221 which tightly fit over the jaw 303.

Figure 5A:
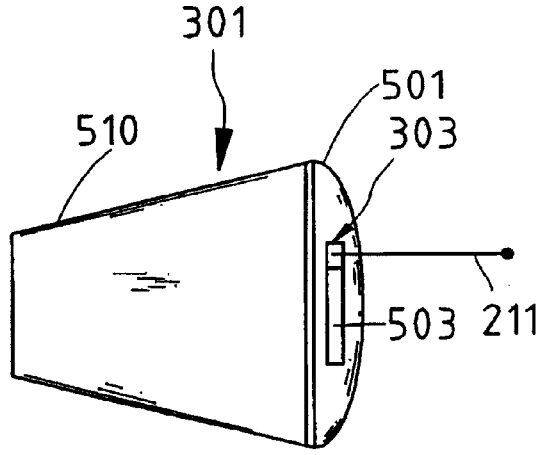
FIG. 5A illustrates one embodiment of a hearing aid with the jaw formed on a face plate.
Figure 5B:
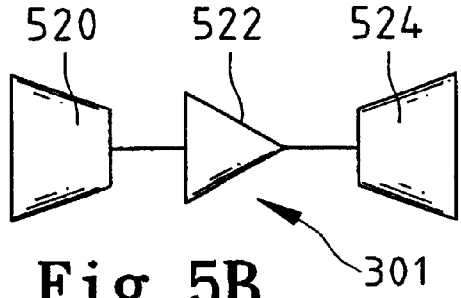
FIG. 5B illustrates one embodiment of an electrical block diagram of a hearing aid.

In one embodiment, the jaw 303 is formed on a face plate 501 of the hearing aid 301, as illustrated in FIG. 5A. The face plate 501 and a shell 510 form the exterior housing of the hearing aid 301. The hearing aid 301 includes a speaker 520 and a microphone 524 coupled to an amplifier 522, illustrated in FIG. 5B, that are inside the exterior housing.

In yet another embodiment, the jaw 303 is placed adjacent to the battery compartment 503 on the face plate 501. The puller 211 is inserted through and attached to the face plate 501 in the manner described above.

Figure 5C:
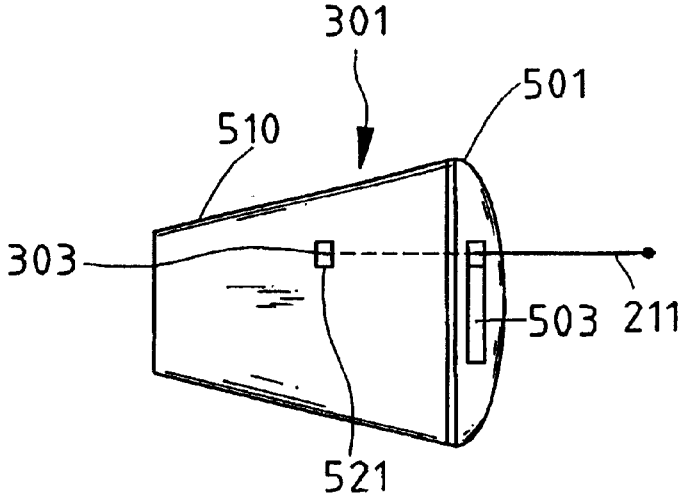
FIG. 5C illustrates one embodiment of a hearing aid with the jaw formed on a shell.

In yet another embodiment, the jaw 303 is attached to the shell 510 of the hearing aid 301, as illustrated in FIG. 5C. Thus, the puller 211 is inserted through the face plate 501 and an opening 521 in the shell 510, and is attached to the shell 510.

In a further embodiment, the puller 211, illustrated in FIG. 2A, is easily attached to the hearing aid 301 in the following manner. The puller 211 is inserted through the face plate 501 and the opening 521 in the shell 510 so that the distal end 214 of the first member 215 protrudes through the opening 521. Then, the puller 211 is attached to the shell 510. In one embodiment, the distal end 214 is glued, or otherwise chemically bonded, to the shell 510. In another embodiment, the distal end 214 is melted, for example into a ball, so that the distal end's cross-section is larger than that of the opening 521.

In yet another embodiment, the puller 211 is cost effectively formed by molding, such as by injection molding. In another embodiment, the puller 211 is formed by a material that can be substantially elongated before breaking. In one embodiment, the puller 211 is formed from a polyamide, such as Nylon-12 manufactured by DuPont Corporation (Wilmington, Del.).

Figure 6:
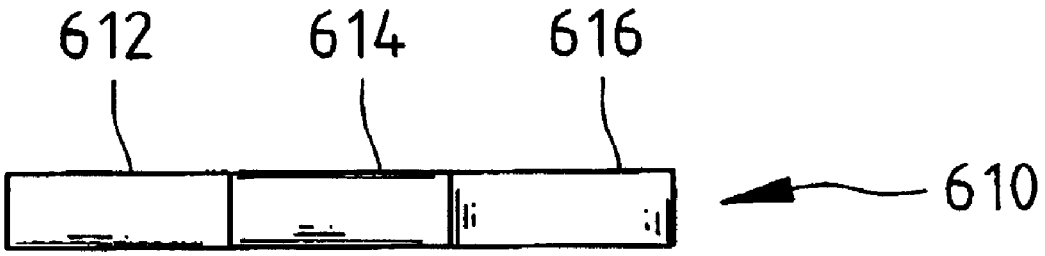
FIG. 6 illustrates one embodiment of an injection molding machine.

One embodiment of injection molding will now be described. Pellets of the polyamide are placed in a hopper 612 of an injection molding machine 610, as illustrated in FIG. 6. The polyamide pellets are augured into a heated barrel 614 of the injection molding machine 610. The barrel 614 may be heated to between about 350 and 550 degrees Fahrenheit when Nylon-12 material is used. The polyamide pellets are melted into liquid form in the barrel 614.

After melting into liquid form in the barrel 614, the polyamide is injected into a mold 616 from the barrel 614. When Nylon-12 material is used, the liquefied polyamide is injected into a mold 616 at a pressure between about 500 and 1500 pounds per square inch. The liquefied polyamide solidifies in the mold 616, for example, after about 3 seconds or more to form the puller 211. In this way, a puller 211 is formed as a single part, without having to add acrylic. Also, additional labor is not required to form knots at the ends of the puller 211 as is conventionally required.

In another embodiment, the puller 211 can be formed by compression molding. In compression molding, the puller 211 is formed by placing solidified material, that can be substantially elongated, between the mold 616 under a relatively high pressure. The relatively high pressure reduces the melting point of the material. The material may be a polyamide. Thus, the material is more readily formable. Techniques for compression molding are known by those skilled in the art.

Other polyamides, including Nylon-6, Nylon-11, and Nylon 6, 12, can be used to form the puller 211. Also, other materials that are elastically deformable can be used instead of a polyamide. A puller 211 formed from elastically deformable material like polyamide can be stretched to more than about twice the original molded length of the puller 211. In one embodiment, prior to installation in the hearing aid, the puller 211 is stretched to a length desired by the hearing aid wearer.

CONCLUSION

The present invention provides a method and apparatus for facilitating the removal of a hearing aid from a wearer's ear. It is an advantage of the present invention that it can be relatively inexpensively manufactured and installed. It is a further advantage that the puller can be custom stretched to a length desired by a wearer. It is yet a further advantage that the puller can be consistently manufactured.

It is understood that the above description is intended to be illustrative, and not restrictive. For example, the shape of the puller 211, such as the first and second members 215, 219 and the first end, second end and intermediate pieces 213, 217, 221, may be modified. For example, the first and second members 215, 219 can have polygonal cross-sections. Also, the first end, second end and intermediate pieces can be substantially shaped like a sphere or a polyhedron. Also, for example, the present invention can be implemented for hearing aids other than CIC hearing aids or other devices that can be inserted in humans, animals or machines. Many embodiments will be apparent to those skilled in the art upon reviewing the above description.

What is claimed is:

1. A hearing aid puller, comprising:

an end piece; and an elongated member having a proximal end and a distal end spaced in a longitudinal direction along the elongated member from the proximal end, with the proximal end coupled to the end piece;

wherein the hearing aid puller is a single, molded part formed from an elastically deformable material, wherein the elongated member is stretchable in the longitudinal direction from a first length along the elongated member and between the proximal and distal ends to a second, longer length along the elongated member and between the proximal and distal ends and wherein the elongated member then maintains the second, longer length.

2. The hearing aid puller of claim 1, comprising:

an intermediate piece coupled to the distal end of the elongated member and spaced longitudinally apart from the end piece by the elongated member;

a second end piece;

a second member having a first end coupled to the intermediate piece and a second end coupled to the second end piece, with the first and second ends being spaced in a spacing direction along the second member, with the second member coupling and spacing apart the intermediate and second end pieces; and wherein a cross-sectional width perpendicular to the spacing direction of the intermediate piece and a maximum width perpendicular to the spacing direction of the second end piece are larger than a cross-sectional width perpendicular to the spacing direction of the second member.

3. The hearing aid puller of claim 2, wherein a cross-sectional width perpendicular to the longitudinal direction of the elongated member and the cross-sectional width perpendicular to the spacing direction of the second member are substantially similar.

4. The hearing aid puller of claim 2, wherein cross sections of the elongated member perpendicular to the longitudinal direction and the second member perpendicular to the spacing direction are substantially circular.

5. The hearing aid puller of claim 2, wherein a cross-sectional width perpendicular to the longitudinal direction of the end piece is larger than the cross-sectional width perpendicular to the spacing direction of the intermediate piece.

6. The hearing aid puller of claim 1, wherein the second, longer length of the elongated member is more than twice the first length.

7. The hearing aid puller of claim 1, wherein the elastically deformable material is a polyamide.

8. The hearing aid puller of claim 7, wherein the polyamide is Nylon-12.

9. A hearing aid, comprising:

a microphone;

an amplifier coupled to the microphone;

a speaker coupled to the amplifier;

a housing which encloses the microphone, amplifier and speaker;

a puller coupled to the housing, including, an end piece, a member having a proximal end and a distal end spaced in a longitudinal direction along the member from the proximal end, with the proximal end coupled to the end piece; and wherein the hearing aid puller is a single, molded part formed from an elastically deformable material, wherein the member is stretchable in the longitudinal direction from a first length along the member and between the proximal and distal ends to a second, longer length along the member and between the proximal and distal ends and wherein the member then maintains the second, longer length.

10. The hearing aid of claim 9, wherein the puller further comprises:

an intermediate piece coupled to the distal end of the member and spaced longitudinally apart from the end piece by the member, a second end piece, a second member having a first end coupled to the intermediate piece and a second end coupled to the second end piece, with the first and second ends being spaced in a spacing direction along the second member, with the second member coupling and spacing apart the intermediate and second end pieces, and wherein a cross-sectional width perpendicular to the spacing direction of the intermediate piece and a maximum width of the second end piece are larger than a cross-sectional width perpendicular to the spacing direction of the second member; and a holder, on the housing, that grasps the second member.

11. The hearing aid of claim 10, with the holder including an opening having a cross-sectional width substantially equal to the cross-sectional width perpendicular to the spacing direction of the second member, with the first and second ends being spaced a length along the second member in the spacing direction, with the holder having a height about equal to or less than the length of the second member, wherein the intermediate piece and second end piece tightly fit over the holder.

12. The hearing aid of claim 10, wherein the holder is a jaw.

13. The hearing aid of claim 12, with the first and second ends of the second member being spaced a length along the second member in the spacing direction, wherein the height of the jaw is about equal to the length of the second member.

14. The hearing aid of claim 10, wherein the housing comprises a face plate coupled to a shell.

15. The hearing aid of claim 14, wherein the holder is formed on the shell.

16. The hearing aid of claim 15, wherein the holder is a jaw.

17. The hearing aid of claim 14, wherein the holder is formed on the face plate.

18. The hearing aid of claim 15, wherein the holder is a jaw.

19. A method of attaching a puller to a hearing aid, comprising:

inserting a first member of the puller into a jaw of the hearing aid;

pulling the puller in a longitudinal direction after the insertion of the first member so that the first member moves from the jaw and a piece of the puller squeezes through the jaw;

snapping the jaw around a second member after the piece squeezes through the jaw; and stretching the hearing aid puller in the longitudinal direction after the jaw is snapped around the second member from a first length to a second, longer length.

20. The method of claim 19, further comprising holding the puller by another piece of the puller after snapping the jaw around the second member and while stretching the hearing aid puller.

21. The method of claim 19, further comprising securing the puller to the hearing aid by tightly fitting the piece and the another piece over the jaw with the jaw and the second member being longitudinally between the piece and the another piece.

22. The method of claim 19, wherein stretching the hearing aid puller comprises stretching the first member of the puller to a length desired by a hearing aid user.

23. A method of attaching a puller to a hearing aid, comprising:

inserting a distal end of a member of the puller through a shell of the hearing aid, with the member having a proximal end spaced in a longitudinal direction along the member from the distal end;

attaching the distal end to the shell; and wherein the puller is a single molded part formed from an elastically deformable material, wherein the member is stretchable in the longitudinal direction from a first length along the member and between the proximal and distal ends to a second, longer length along the member and between the proximal and distal ends and wherein the member then maintains the second, longer length when the distal end is attached to the shell.

24. The method of claim 23, wherein attaching comprises bonding the distal end to the shell.

25. A method of forming a hearing aid puller comprising: molding elastically deformable material to form a single part hearing aid puller including an end piece coupled to a proximal end of a member, with the member further including a distal end spaced in a longitudinal direction along the member from the proximal end, wherein the elastically deformable material allows the member to be stretched in the longitudinal direction from a first length along the member and between the proximal and distal ends to a second, longer length along the member and between the proximal and distal ends and wherein the member then maintains the second, longer length.

26. The method of forming a hearing aid puller of claim 25, further comprising:

injecting liquefied elastically deformable material into a mold; and cooling the liquid elastically deformable material in the mold to form the hearing aid puller that is a single part and can be stretched to more than about twice the hearing aid puller's original molded length.

27. The method of claim 26, wherein the liquefied elastically deformable material is a polyamide.

28. The method of claim 27, wherein injecting an elastically deformable material further comprises injecting liquefied elastically deformable material that is liquefied polyamide.

29. The method of claim 28, wherein injecting liquefied polyamide further comprises injecting liquefied polyamide that is liquefied Nylon-12 heated to a temperature between about 350 and 550 degrees Fahrenheit.

30. The method of claim 28, wherein injecting liquefied polyamide further comprises injecting liquefied polyamide that is liquefied Nylon-12 at a pressure between about 500 and 1500 pounds per square inch.

31. A hearing aid puller, comprising:

a polyamide member having a first end adapted for mounting to a hearing aid and a second end adapted to be grasped, with the first end being spaced from the second end in a longitudinal direction along the polyamide member, wherein the polyamide member is stretchable in the longitudinal direction from a first, undeformed length along the polyamide member and between the first and second ends to a second, longer length along the polyamide member and between the first and second ends and wherein the member then maintains the second, longer length.

32. The hearing aid puller of claim 31, wherein the second, longer length of the polyamide member is more than twice the first, undeformed length.

33. The hearing aid puller of claim 31, wherein the polyamide is Nylon-12.

34. A hearing aid puller system, comprising:

a hearing aid housing having a holder including a jaw, with the jaw including a first side, a second side and an opening extending between the first and second sides; and a puller which includes:

a first member;

an intermediate piece coupled to the first member;

a second member coupled to the intermediate piece and separated from the first member by the intermediate piece; and an end coupled to the second member, wherein the second member is shaped to fit within the opening of the holder so that the end is located outside of the opening and abuts a surface of the first side of the jaw and the intermediate piece is located outside of the opening and abuts an opposing surface on a second side of the jaw.

35. The hearing aid puller system of claim 34, wherein the jaw fits flushly against the second member when the second member is located within the holder.

36. The hearing aid puller system of claim 34, wherein the puller further includes a second end coupled to the first member which is adapted for grasping the puller.

37. A hearing aid puller, comprising:

an elongated member;

an intermediate piece coupled to the elongated member;

a second member coupled to the intermediate piece and separated from the elongated member by the intermediate piece in a longitudinal direction; and an end piece coupled to the second member, with the intermediate piece, the second member, and the end piece having cross-sections perpendicular to the longitudinal direction, with the cross-sections perpendicular to the longitudinal direction of the second member being smaller than the cross-sections perpendicular to the longitudinal direction of the intermediate and end pieces, with the end piece having semicircular cross-sections parallel to the longitudinal direction.

* * * * *